US006056924A

United States Patent [19]

Jackson et al.

[11] Patent Number: 6,056,924

[45] Date of Patent: May 2, 2000

[54] MODIFIED TEST TUBE

[76] Inventors: Milton L. Jackson; Jenny A. Barajas, both of 4113 Chester Dr., Ypsilanti, Mich. 48197

[21] Appl. No.: 08/762,773

[22] Filed: Dec. 10, 1996

[51] Int. Cl.[7] ..... B01L 3/14

[52] U.S. Cl. ..... 422/102; 422/61; 422/99; 422/100; 422/104

[58] Field of Search ..... 422/58, 61, 99, 422/100, 102, 104; 206/443, 563, 446, 562, 588, 589; 211/74, 60.1, 71.01, 77, 78

[56] References Cited

U.S. PATENT DOCUMENTS

| | | | |
|---|---|---|---|
| D. 296,928 | 7/1988 | Lee et al. | D24/32 |
| 1,312,340 | 8/1919 | Mojonnier | 422/100 |
| 1,352,490 | 9/1920 | Wilkins | 206/763 |
| 1,660,974 | 2/1928 | Porro | 422/102 |
| 2,288,065 | 6/1942 | Benotti | 422/102 |
| 2,616,751 | 11/1952 | Goldenberg | 211/74 |
| 2,625,823 | 1/1953 | Erickson | 422/102 X |
| 3,186,556 | 6/1965 | Forsstrom | 211/74 |
| 3,581,929 | 6/1971 | Guenard | 211/60.1 |
| 3,590,752 | 7/1971 | DePew | 211/60.1 |
| 3,643,812 | 2/1972 | Mander et al. | 206/443 X |
| 3,905,482 | 9/1975 | Knulst | 211/74 |
| 4,207,289 | 6/1980 | Weiss | 422/104 |
| 4,446,964 | 5/1984 | Moran | 206/321 |
| 4,787,988 | 11/1988 | Bertonicini et al. | 210/808 |
| 5,033,626 | 7/1991 | Platti | 211/37 |
| 5,080,232 | 1/1992 | Leoncavallo et al. | 206/446 |
| 5,141,117 | 8/1992 | Olsen et al. | 211/71 |
| 5,169,603 | 12/1992 | Landsberger | 422/104 |
| 5,494,166 | 2/1996 | Kuwata et al. | 206/528 |
| 5,575,385 | 11/1996 | Zona | 206/256 |

OTHER PUBLICATIONS

VWR Scientific catalog, p. 210, showing Nunclon™ ▽ flat sided and culture tubes. No Date Provided.

Corning Glassware catalog, 1995, p. 265, showing tube with flat window and showing tube with sidearm.

James W. Queen and Co. catalog, circa 1875, pp. 22–23, showing side neck test tube and ignition tube.

*Primary Examiner*—Lyle A. Alexander

*Attorney, Agent, or Firm*—David P. Gordon; David S. Jacobson; Thomas A. Gallagher

[57] ABSTRACT

A modified test tube is provided which can sit on any flat surface unaided by a test tube rack. The modified test tube includes a tubular containment portion and tubular neck portion. The containment portion has a flattened bottom surface and a closed end. The neck portion is angled approximately 45° relative to the flattened surface and has a mouth which opens parallel to the flattened bottom surface. The flattened bottom surface of the modified test tube enables the test tube to sit prone on any flat surface by itself, unaided by a rack, and the bent neck portion prevents the contents from spilling from the test tube. This design enables the contents within the test tube to be easily monitored without moving the test tube. A test tube rack is further provided for storing the test tubes. The test tube rack is generally a substantially solid transparent cylindrical member having a plurality of radial cavities, spaced such that each does not intersect another, or a plurality of holes in the thick walls of a transparent tubular member. The cavities or holes may be arranged into several horizontal levels.

13 Claims, 6 Drawing Sheets

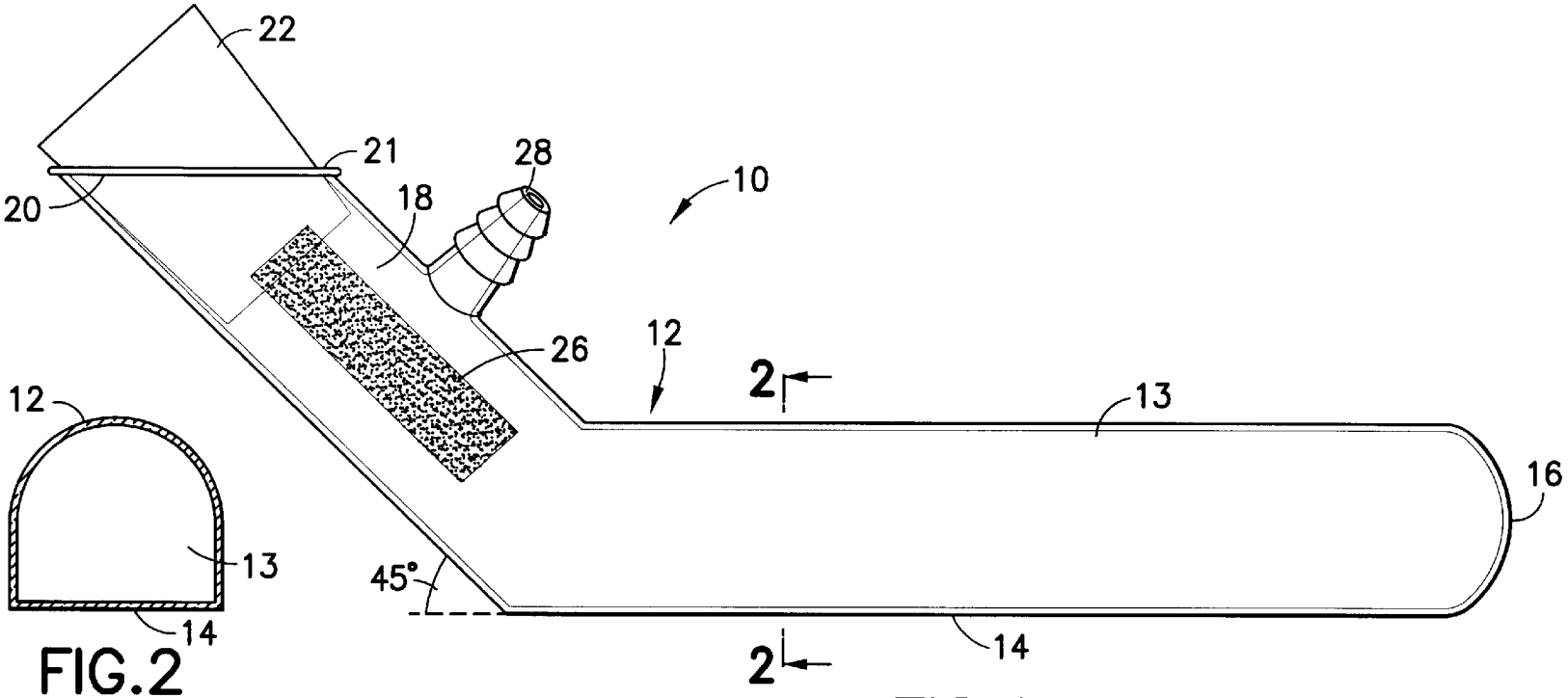
FIG. 1
FIG. 2
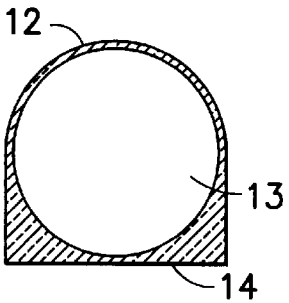
FIG. 2A

MODIFIED TEST TUBE

BACKGROUND OF THE INVENTION

1. Field of the Invention

This invention relates broadly to laboratory equipment. More particularly, this invention relates to test tubes and test tube racks.

2. State of the Art

Standard test tubes are tubular in shape and have a rounded sealed bottom end and an open top end. The standard test tube design possesses a high degree of utility in laboratory experimentation and research. In fact, it is anticipated that the standard shape test tube will continue to dominate the test tube market due to its simplicity and design familiarity. Yet, this dominance is in spite of drawbacks associated with the standard design.

Standard test tubes require the use of a rack for support, as the test tubes cannot stand on their own. Unless the open end of a standard test tube is closed with a stopper, when the test tube is placed on a flat surface without the use of a rack, the contents of the test tube will spill out. Therefore, standard test tubes, regardless of size, generally require the use of a test tube rack to hold the test tubes while the test tubes are being utilized. As a result, when placing a standard test tube into a heated water bath, the test tube must first be placed into a test tube rack and then the entire rack must be inserted into the water, such that the test tubes are substantially submerged. This results in more time and energy needed to bring the contents of the standard test tubes to the desired temperature. Furthermore, as a substantial portion of the standard test tube is submerged in the water bath, it is difficult to monitor reactions occurring within the test tube. Moreover, when applying heat to a standard test tube, it is common to place the test tube in a clamp and to apply a flame under the test tube. This often provides uneven heating of the contents, as heat is applied primarily only under the bottom of the test tube and may cause the contents at the bottom of the tube to scorch. In addition, standard test tubes cool slowly as cool air will only come into contact with a small surface area of the contents of the tube. Another disadvantage is that when adding or heating reagents in a standard test tube there is a strong potential for harmful spatter from "bumping" (the rapid evolution of gas bubbles) to occur which can result in sample loss. Furthermore, when adding a substance to a test tube in situations where the substance weight is critical, the substance must first be weighed on weighing paper and then transferred into the test tube. As some of the substance will remain on the weighing paper after the bulk of the substance has been transferred to a test tube, experimental error is introduced into the system.

As discussed above, standard test tubes require a test tube rack. Standard test tube racks usually have upper and lower horizontal holding members and vertical supports. The upper holding member has a plurality of holes arranged in a two dimensional array, each of the holes being slightly larger than the diameter of the standard test tubes which the rack is designed to hold. The lower holding member has a plurality of depressions aligned below the holes of the upper holding member. A standard test tube extends through one of the holes in the upper holding member and seats in the depression aligned beneath the hole through which the test tube extends.

Standard test tube racks, like standard test tubes, also carry substantial disadvantages. First, it is difficult to monitor and observe reactions occurring in a test tube held in a standard rack if the test tube is not located along the edge of the two-dimensional array. This problem is compounded when a large number of tubes fill the rack, making observation of the contents below the mouths of the tubes even more difficult. Second, standard racks require a substantial amount of space, as their design is not generally conducive to stacking. In those racks which are stackable, once the racks are stacked, observation of a test tube within a lower rack is not possible and removal of a test tube from a lower rack requires removing the racks stacked above the lower rack.

SUMMARY OF THE INVENTION

It is therefore an object of the invention to provide a modified test tube which can be seated in a stable position without the use of a test tube rack and can be stood vertically with the use of a conventional test tube rack.

It is also an object of the invention to provide a modified test tube which will not spill when seated prone.

It is another object of the invention to provide a modified test tube which allows relatively easy monitoring of the contents of the test tube.

It is an additional object of the invention to provide a modified test tube which permits even heating of its contents.

It is a further object of the invention to provide a modified test tube which permits the contents of the test tube to have a relatively larger area in contact with ambient air.

It is yet another object of the invention to provide a test tube rack for a modified test tube which provides access to each test tube located therein when stacked below another test tube rack.

It is yet a further object of the invention to provide a test tube rack for a modified test tube which enables observation of the contents of each of the test tubes held in the rack.

In accord with these objects which will be discussed in detail below, a modified test tube is provided which can sit on any flat surface unaided by a test tube rack. The modified test tube is an elongate, substantially tubular member defining a containment portion and a neck portion. The containment portion has a flattened bottom surface and a closed end and the neck portion has a mouth. The neck portion is angled approximately 45° relative to the flattened bottom surface and the mouth opens parallel to the flattened bottom surface. In addition, a test tube rack is provided for housing the modified test tubes. The test tube rack is a transparent cylindrical member having a plurality of substantially horizontal cavities shaped for receiving the closed end of the modified test tubes.

It will be appreciated that the flattened bottom surface of the modified test tube enables the test tube to sit on any flat surface by itself, unaided by a rack, and that the bent mouth portion prevents the contents from spilling from the test tube. Additionally, the modified test tube may be used in the vertical position and is, accordingly, compatible with standard test tube racks and other conventional laboratory equipment. It will also be appreciated that this design enables the contents within the modified test tube to be easily monitored and observed without moving the test tube, which is usually required when a standard test tube is seated in a rack. The modified test tube may also be placed directly into a water bath without the use of rack. In addition, the contents of the modified test tube may be more evenly heated as heating can be done with the test tube in a prone orientation, and the prone configuration of the test tubes provides the contents with an increased surface area, thereby reducing the potentially harmful spatter from "bumping" and permitting the contents to cool more rapidly and evenly. Furthermore, an empty modified test tube can easily be placed on a zero balance scale and substances can be added directly to the test tube without the necessity of weighing paper.

A test tube rack designed to particularly take advantage of the improvements offered by the modified test tube is also provided. The test tube rack is generally a substantially solid transparent cylindrical member having a plurality of radial cavities, spaced such that each does not intersect another, or a plurality of holes in the thick walls of a transparent tubular member. The cavities or holes may be arranged into several horizontal levels.

Additional objects and advantages of the invention will become apparent to those skilled in the art upon reference to the detailed description taken in conjunction with the provided figures.

BRIEF DESCRIPTION OF THE DRAWINGS

FIG. 1 is a side elevation view of the modified test tube of the invention;

FIG. 2 is a cross-section across line 2—2 of FIG. 1;

FIG. 2A is a cross-section of an alternative embodiment across line 2—2 of FIG. 1;

DETAILED DESCRIPTION OF THE PREFERRED EMBODIMENTS

Figure 3:
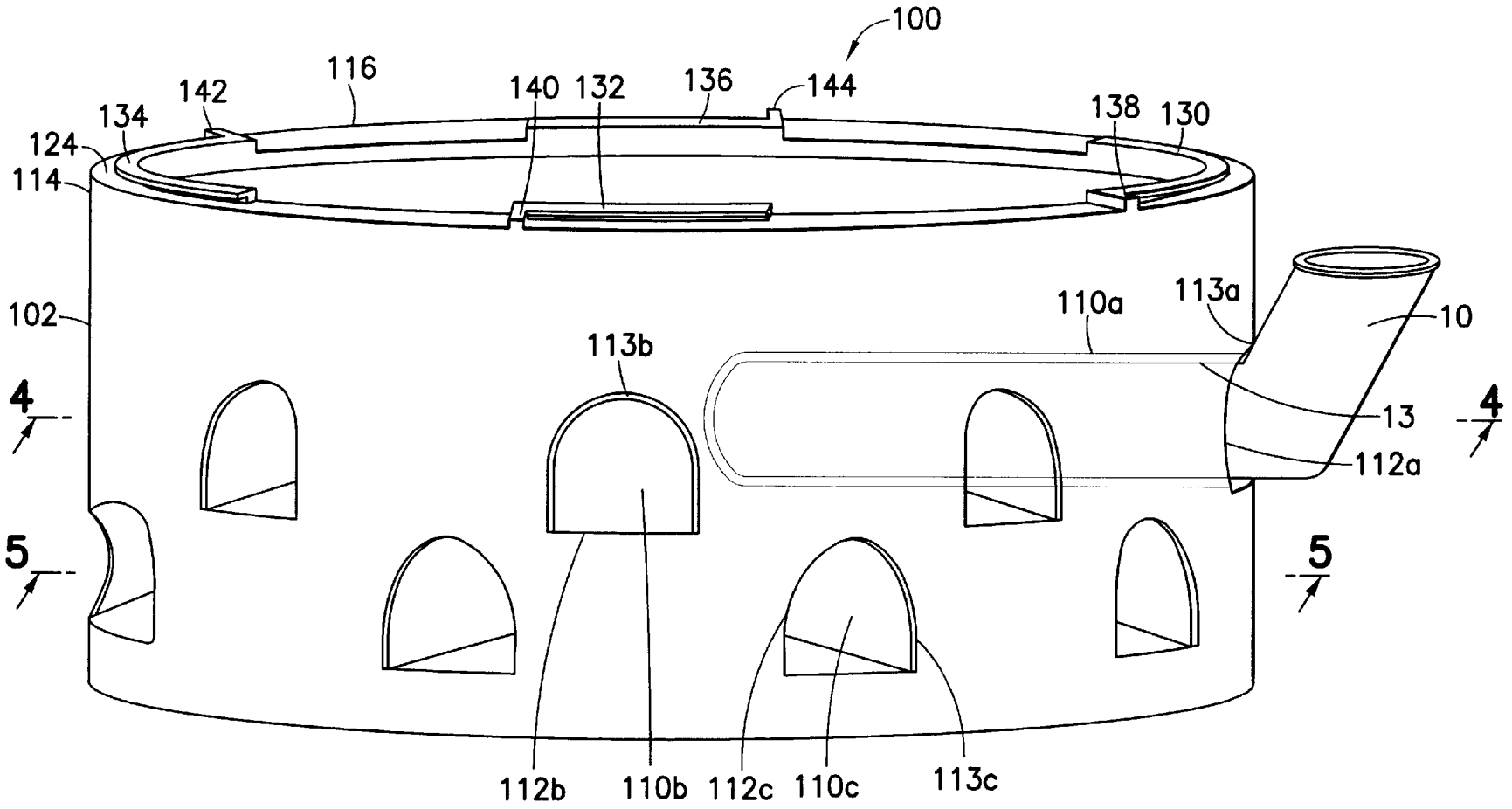
FIG. 3 is a perspective view of a test tube rack according to the invention.

Turning now to FIG. 1, the modified test tube 10 of the invention is shown. The modified test tube 10 is a transparent, substantially tubular member 12, preferably made of glass or plastic. The tubular member 12 has a containment portion 13 coupled to a neck portion 18. The containment portion 13 has a flattened bottom surface 14, a closed end 16. The interior of the containment portion may be non-circular in cross-section (FIG. 2) or generally circular or ovoid in cross-section (FIG. 2A). The neck portion 18 is angled upwards approximately 45° relative to the flattened bottom surface 14 and has a mouth 20 substantially parallel to the flattened bottom surface. The mouth 20 preferably has a lip 21, and can be sealed with a standard rubber stopper 22. Alternatively, the mouth can include an external thread (not shown) which receives a threaded cap (not shown). A roughened or frosted patch 26 is provided on the surface of the neck 18 providing a surface on which to mark the test tube with a pen or pencil or to apply a bar code. A side arm 28 may also be provided on the neck 18 (shown) or on the containment portion 13 (not shown).

It will be appreciated that the flattened surface enables the test tube to sit prone on any flat surface by itself, unaided by a rack, and that the bent mouth portion prevents the contents from spilling from the test tube while prone. As such, a number of advantages are realized over the standard test tube design.

It will also be appreciated that the closed end of the modified test tube is designed to fit in a standard test tube rack, as well as other conventional laboratory equipment, e.g. clamps. However, in order to take advantage of the improvements of the modified test tube and to further offer a radical alternative to the standard test tube rack design, an improved rack for the modified test tube is hereby provided.

Figure 5:
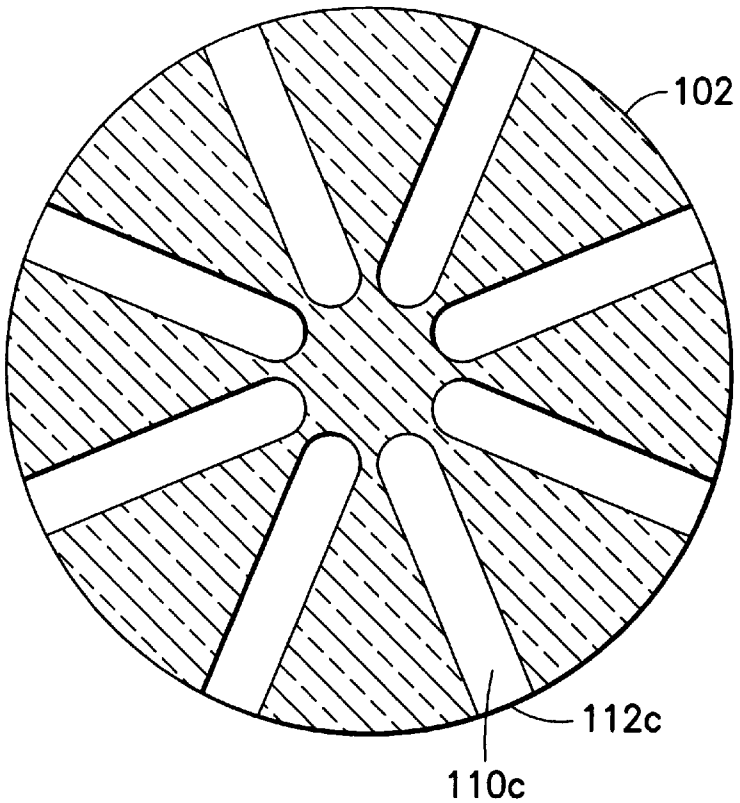
FIG. 5 is a cross sectional view across line 5—5 of FIG. 3.
Figure 4:
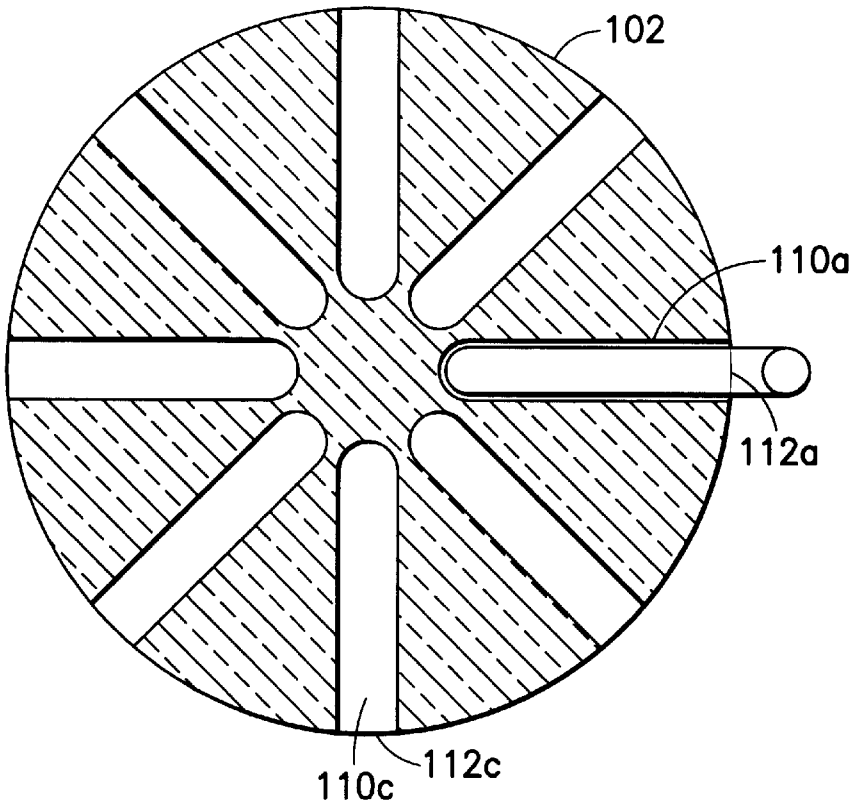
FIG. 4 is a cross-sectional view across line 4—4 of FIG. 3.

Turning to FIG. 3, a test tube rack 100 housing a modified test tube 10 is shown. Generally, the test tube rack 100 is a substantially solid cylinder 102 of a preferably transparent material, e.g., glass or plastic. The solid cylinder 102 has a plurality of radially aligned cavities 110*a*, 110*b*, 110*c* shaped to receive the containment portions 13 of the modified test tubes having cavity mouths 112*a*, 112*b*, 112*c* at the periphery of the cylinder 102. The mouths preferably have a substantially flat lower surface and a curved upper surface such that they are each provided with an inverted 'U' shape. The cavities are spaced such that each does not intersect another and may be further arranged into several horizontal levels, e.g., the two layers illustrated in FIGS. 3, 4, and 5. Preferably, the mouths 112*a*, 112*b*, 112*c* are chamfered 113*a*, 113*b*, 113*c* to engage a neck portion 18 of the modified test tube 10.

Figure 7:
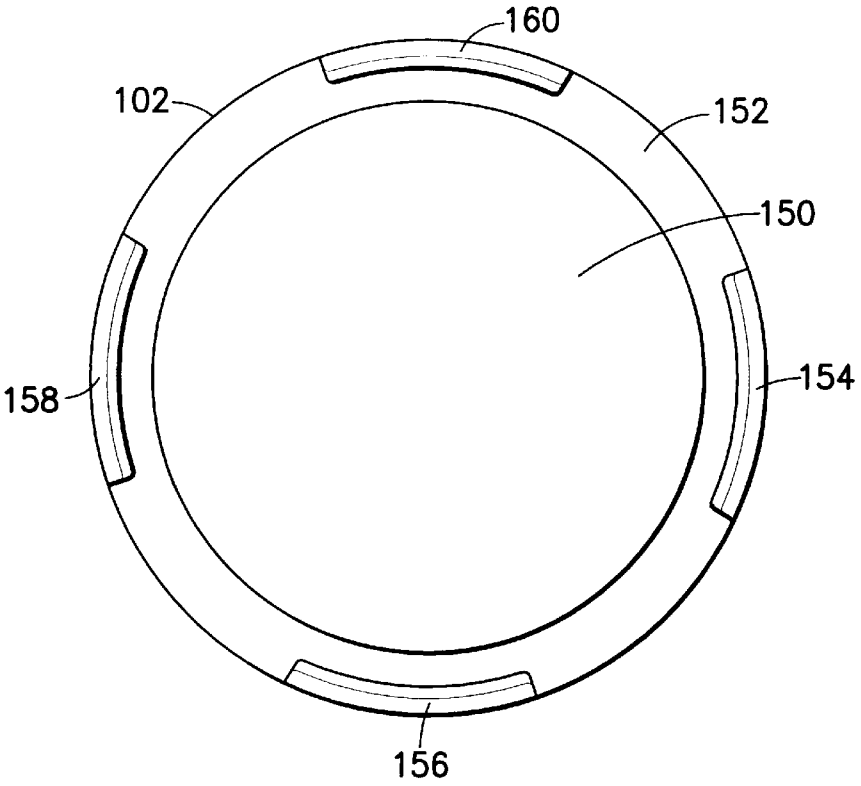
FIG. 7 is a reduced bottom view of the test tube rack shown in FIG. 3.
Figure 6:
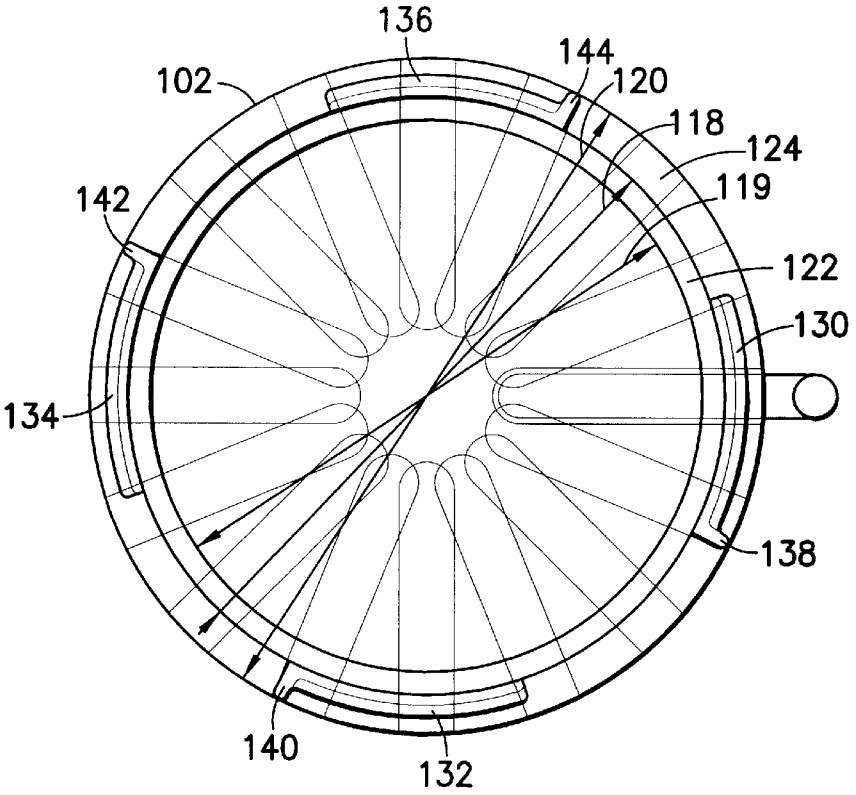
FIG. 6 is a reduced top view of the test tube rack shown in FIG. 3.

Referring to FIGS. 3, 6, and 7, a top portion 114 of the rack 100 includes a wall 116 having a lower inner diameter 119, an upper inner diameter 118, an outer diameter 120, a recessed lower lip 122, and a circumferential channel 124. Several top catch members 130, 132, 134, 136 are provided at the channel 124. Each top catch member 130, 132, 134, 136 rises vertically from the channel 124 adjacent the recessed lower lip 122 and angles approximately 90° towards the periphery of the rack, extending across a portion of the channel 124. One end of each of the top catch members, but the same side for each, is provided with a stop 138, 140, 142, 144 which is orthogonal to both the rising and peripherally extending portions of the catch members 130, 132, 134, 136.

Referring to FIGS. 3 and 7, the bottom of the rack includes a bottom surface 150 and a recessed peripheral lip 152. The bottom surface 150 supports the rack 100 when the rack is seated on a flat surface and has a diameter substantially the same as the upper inner diameter 118. The recessed peripheral lip 152 is provided with a plurality bottom catch members 154, 156, 158, 160 descending from the outermost periphery of the recessed lip, then angling approximately 90° towards the central axis (axis of rotation) of the cylindrical member 102, and extending across a portion of the peripheral lip 152.

Figure 9:
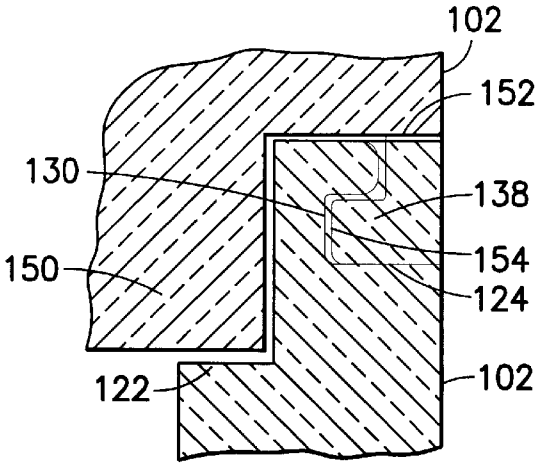
FIG. 9 is a cross-sectional view across line 9—9 of FIG. 8.
Figure 10:
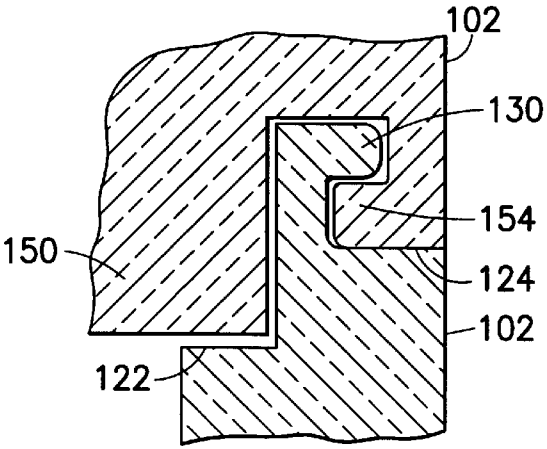
FIG. 10 is a cross-sectional view across line 10—10 of FIG. 8.
Figure 8:
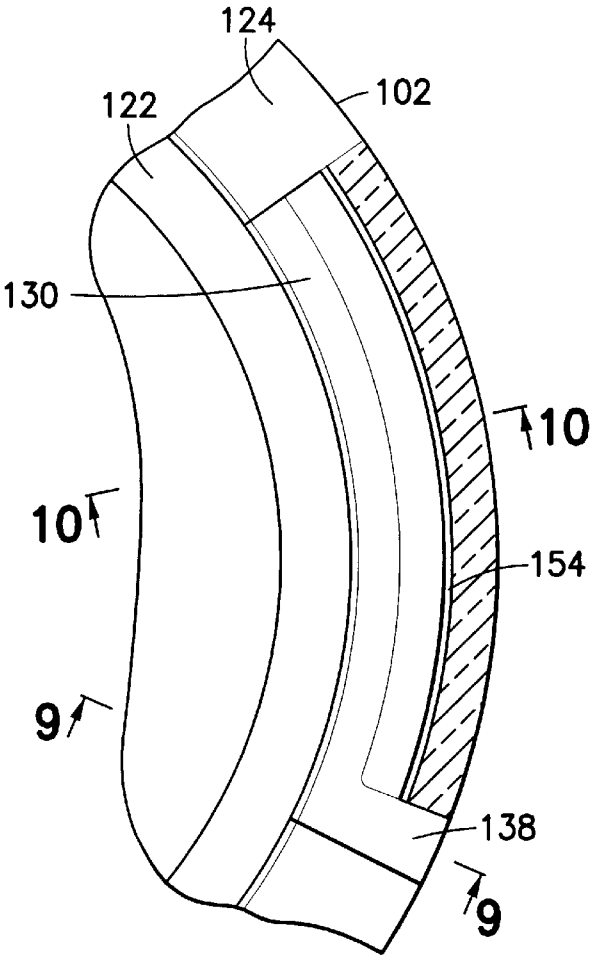
FIG. 8 is an enlarged broken partial top view of the locking mechanism of the test tube rack of the invention.

It will be appreciated that several racks may stacked one on top of another. With respect to a stack of two racks, the bottom surface of the upper rack seats into the recessed lower lip at the top of the lower rack. The top catch members and the bottom catch member are initially aligned such that the bottom catch members lie between the top catch members. Once the two stacks are in such alignment, the rack upper in the stack is rotated relative to the rack lower such that corresponding top and bottom catch members interlock and the two racks are secured relative to each other, as illustrated in FIGS. 8, 9, and 10. Stops 138, 140, 142, 144 on the catch members prevent further rotation in one rotational direction when the bottom catch member abuts the stop. It will be appreciated that more than two racks may be likewise secured in a stack in the same manner. It will be further appreciated that every test tube in each of the racks of a stack remains relatively visible, relatively observable, and immediately accessible.

Figure 11:
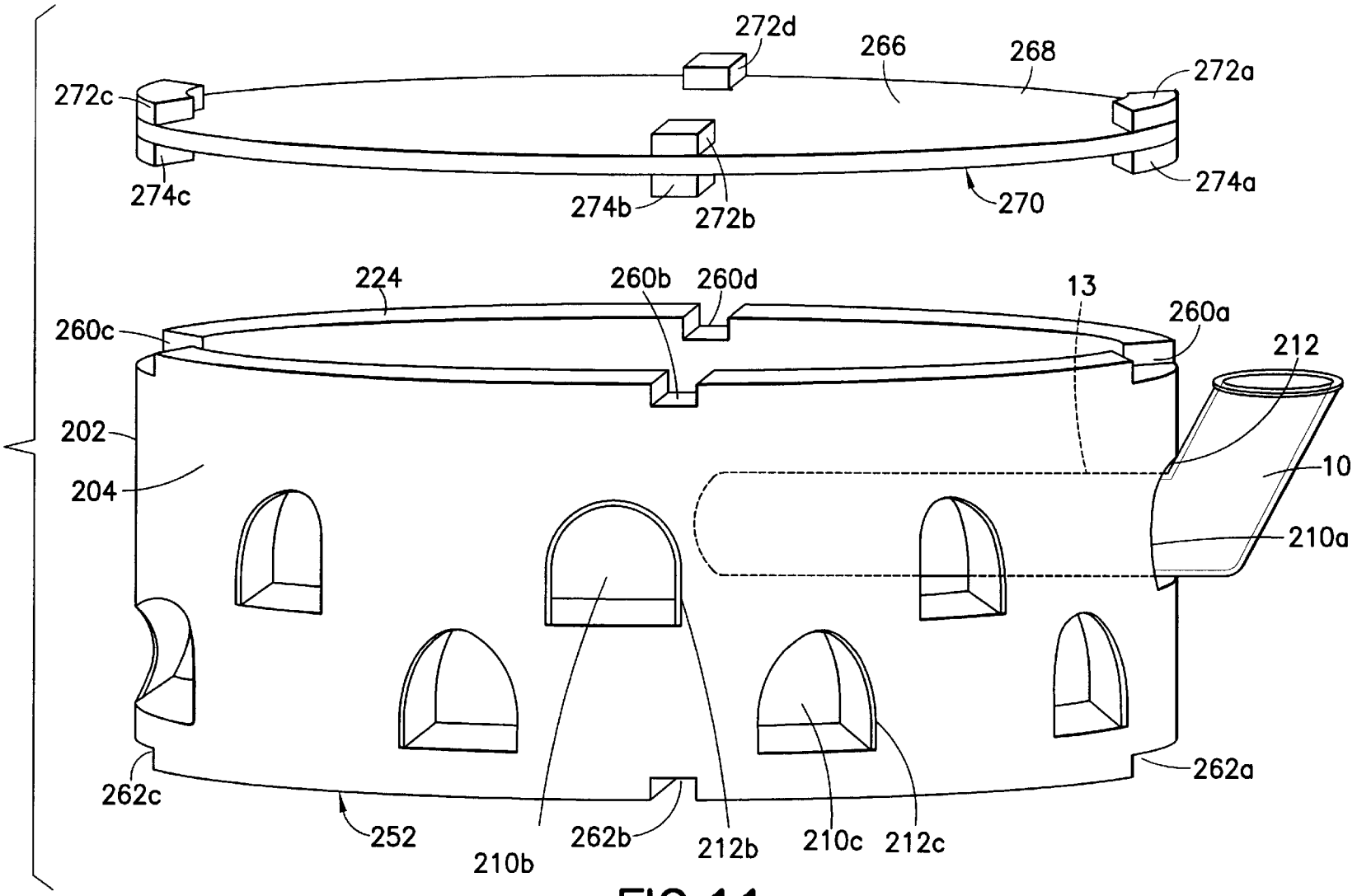
FIG. 11 is an exploded perspective view of a second embodiment of the test tube rack of the invention.

Turning now to FIG. 11, a second embodiment of the test tube rack, substantially similar to the first embodiment (with like parts have similar numbers incremented by 100), is shown. The test tube rack 200 is a tubular member 202, preferably of a transparent material, having a relatively thick wall 204 defining a plurality of cavities or holes 210*a*, 210*b*, 210*c* shaped to receive the containment portions 13 of the modified test tubes 10. The holes 210*a*, 210*b*, 210*c* include a mouth or entrance 212*a*, 212*b*, 212*c* which may be chamfered to engage a neck portion 18 of the modified test tube 10. The thickness of the wall 204 is such that support is provided for a test tube 10 extending through a hole without any further support for the test tube. The thick wall 204 has an upper lip 224 and a bottom lip 252. The top lip 224 is provided with several notches 260*a–c* at regular intervals around the circumference of the top lip. Likewise the bottom lip 252 is provided with several notches 262*a–c* (262*d* not shown). A disc-shaped connecting cover 266 is provided as a cover for the rack and as a means for easily stacking the racks. The connecting cover 266 has an upper side 268 and a lower side 270. The upper side 268 has several upper nubs 272*a–d* around the periphery of the upper side 268 of the cover, of a shape, size and number corresponding to the notches 260*a–d* provided in the top lip. Likewise, the lower side 270 has several lower nubs 274*a–d* (274*d* not shown) around the periphery of the lower side 270 of the cover, of a shape, size and number corresponding to the notches 262*a–d* provided in the bottom lip 252. The connecting cover is applied over the upper lip 224 of the lower rack in the stack such that lower nubs 274*a–d* on the lower side 270 of the connecting cover seat in the notches 260*a–d* of the upper lip 274. The upper rack in the stack is then seated onto the connecting cover 266 such that the notches 262*a–d* seat on the upper nubs 272*a–d* on the upper side 268 of connecting cover 266. As a result, the racks can be stacked in a relatively stable manner, and similar advantages are attained as in the first embodiment. It will be appreciated that the connecting cover further serves as a divider between a stack of racks preventing any material, e.g. a broken test tube, from falling through a lower rack in a stack. It will be further appreciated that the connecting cover can be designed to be integral with the top or bottom portions of a rack.

There have been described and illustrated herein several embodiments of a test tube and a rack for receiving the test tube. While particular embodiments of the invention have been described, it is not intended that the invention be limited thereto, as it is intended that the invention be as broad in scope as the art will allow and that the specification be read likewise. Thus, while glass and plastic have been disclosed as materials for constructing the test tube and the rack, it will be appreciated that other materials may be used as well. Also, while a stopper and a screw top have been disclosed for sealing the test tube, it will be understood that other sealing means can be similarly used. For example, the mouth can be modified for an aerobic/anaerobic cap if desired. In addition, the inside of the containment portion can be circular, oval, or otherwise shaped. Furthermore, the connection between the containment and neck portions can be as shown or curved. Moreover, while the neck is disclosed to angle upwards approximately 45° relative to the flattened bottom surface or to the legs, it will be appreciated that the angle may be greater than or less than 45°, as the exact angle is not critical. Rather, what is critical is that the angle of the neck portion relative to the containment portion in conjunction with the length of the neck relative to the length of the containment portion should provide a test tube which can be seated in a stable position on its flattened bottom surface and further provide a mouth location that will prevent the test tube contents from spilling therefrom when the test tube is seated. Also, the diameter of the neck and containment portions can be substantially the same or different. In addition, while a single side arm is shown on the neck portion of the test tube, it will be appreciated that one or more side arms may likewise be provided on the neck portion or containment portion of the test tube. Furthermore, the mouth opening or lip can be angled relative to or parallel with the flat bottom surface.

In addition, while a cylindrical shape is preferred for the rack, it will be appreciated that other shapes, i.e. such that the rack has a rectangular or triangular cross-section, may also be used. Furthermore, it will also be appreciated that while particular designs for interlocking the racks have been disclosed, other manners for interlocking the racks together may be utilized. Moreover, while the connecting cover is disclosed as a distinct element for connecting two racks vertically, it will also be appreciated that the features of the connecting cover may be designed integrally into the bottom of the rack, i.e., the rack has a solid bottom portion having bottom nubs protruding vertically which would interlock with notches in the top lip of a lower rack in a stack. Also, while four pairs of interlocking catch members and four pairs of notches and nubs have been disclosed for securing a stack of racks together, it will be appreciated that no locking means is necessary and that at least one locking means is preferred. Furthermore, where more than one pair of interlocking catch members are utilized, a stop is preferable on only at least one of the catch members. It will therefore be appreciated by those skilled in the art that yet other modifications could be made to the provided invention without deviating from its spirit and scope as so claimed.

We claim:

1. A test tube rack for use with one or more test tubes having a containment portion and a neck portion angled relative to the containment portion, the containment portion having an axis and a non-circular cross-section, said test tube rack comprising:

a rack member defining a plurality of substantially radially arranged cavities such that a radius passing through any one of said cavities is not colinear with a radius passing through any other of said cavities, each of said cavities having a lateral opening shaped and sized to receive the containment portion and to prevent rotation of the test tube about the axis of the containment portion.

2. A test tube rack according to claim 1, wherein:

said lateral openings are chamfered to substantially flushly abut the neck portion of the test tube.

3. A test tube rack according to claim 1, wherein:

said rack member is substantially transparent.

4. A test tube rack according to claim 1, wherein:

said rack member is made of one of plastic and glass.

5. A test tube rack according to claim 1, wherein:

said rack member includes first and second locking means for interlocking with other of said test tube racks and for unlocking from the other of said tube racks, said first locking means provided to said rack member vertically under all of said plurality of cavities and said second locking means provided vertically above all of said plurality of cavities.

6. A test tube rack according to claim 1, wherein:

said rack member is substantially solid.

7. A test tube rack according to claim 6, wherein:

said rack member is cylindrically shaped.

8. A test tube rack according to claim 6, wherein:

said plurality of cavities are planar.

9. A test tube rack according to claim 1, wherein:

said rack member is hollow and has a thick wall which defines said plurality of cavities.

10. A test tube rack according to claim 9, wherein:

said rack member is cylindrically shaped.

11. A test tube rack according to claim 9, further comprising:

at least one of a substantially solid bottom cover and a substantially solid top cover.

12. A test tube rack according to claim 9, wherein:

said rack member includes first and second locking means for interlocking with other of said test tube racks and for unlocking from the other of said test tube racks, said first locking means provided to said rack member vertically under all of said plurality of cavities and said second locking means provided vertically over all of said plurality of cavities.

13. A laboratory kit, comprising:

a) at least one test tube defining a containment portion, a neck portion angled relative to said containment portion, a closed end, and an open end, said containment portion having a non-circular cross-section with a cross-sectional area and an axis, and said closed end having a cross-sectional area equal to or smaller than the cross-sectional area through said containment portion; and b) a test tube rack member defining a plurality of cavities, each of said cavities having a lateral opening shaped with substantially the same non-circular shape as said containment portion of one of said at least one test tube and sized to stably receive said containment portion such that rotation of said one of said at least one test tube about the axis of said containment portion of said at least one test tube is prevented.

* * * * *